US006629837B2

(12) United States Patent
Carbone et al.

(10) Patent No.: US 6,629,837 B2
(45) Date of Patent: Oct. 7, 2003

(54) INTEGRATED PREMIXED INDIRECT RADIANT BURNER

(76) Inventors: Philip C. Carbone, 6 Adrian Dr., North Reading, MA (US) 01864; Karen R. Benedek, 37 Emmerson Rd., Winchester, MA (US) 01890; Stephan E. Schmidt, 10 Janis Ter., Woburn, MA (US) 01801; Richard A. Shandross, 81 Hibbert St., Arlington, MA (US) 02476; William J. Goetzler, 15 Strathmore Rd., Apt. 1, Brookline, MA (US) 02445; Peter P. Payne, 118 N. Chester Ave., Park Ridge, IL (US) 60068

( * ) Notice: Subject to any disclaimer, the term of this patent is extended or adjusted under 35 U.S.C. 154(b) by 0 days.

(21) Appl. No.: 09/780,543

(22) Filed: Feb. 9, 2001

(65) Prior Publication Data

US 2002/0045145 A1 Apr. 18, 2002

Related U.S. Application Data

(60) Provisional application No. 60/181,480, filed on Feb. 10, 2000.

(51) Int. Cl.[7] ..... F23D 14/62; F23D 14/04

(52) U.S. Cl. ..... 431/354; 431/8; 431/326

(58) Field of Search ..... 431/354, 350, 431/326, 328, 75, 7, 8, 9, 12, 174; 126/39 J, 91 R, 92 C, 92 AC, 92 R, 92 B

(56) References Cited

U.S. PATENT DOCUMENTS

| | | | | | |
|---|---|---|---|---|---|
| 1,113,174 | A | * | 10/1914 | Lucke et al. | 431/328 |
| 2,497,104 | A | * | 2/1950 | Vandiver | 431/354 |
| 2,806,465 | A | * | 9/1957 | Hess | 126/92 AC |
| 3,067,811 | A | * | 12/1962 | Webster | 431/328 |
| 3,805,763 | A | * | 4/1974 | Cowan | 126/92 B |
| 4,413,976 | A | * | 11/1983 | Scherer | 431/328 |
| 4,533,318 | A | * | 8/1985 | Buehl | 126/92 AC |
| 5,062,788 | A | | 11/1991 | Best | 431/354 |
| 5,326,257 | A | | 7/1994 | Taylor et al. | 431/329 |
| 5,641,282 | A | * | 6/1997 | Lee et al. | 126/91 A |
| 5,800,156 | A | * | 9/1998 | Kahlke et al. | 431/328 |
| 5,800,157 | A | * | 9/1998 | Hasse et al. | 431/328 |

FOREIGN PATENT DOCUMENTS

| | | | |
|---|---|---|---|
| DE | 24 40 701 A | * | 11/1976 |
| JP | 1-252808 A | * | 10/1989 |

* cited by examiner

*Primary Examiner*—Henry Bennett
*Assistant Examiner*—Josiah Cocks
(74) *Attorney, Agent, or Firm*—Mark E. Fejer

(57) ABSTRACT

A gas-fired burner wherein a back plate having at least one inlet tube is connected with respect to a flameholder plate having a plurality of ports. The flameholder plate and the back plate form a plenum. A plurality of mixing baffles are formed within the plenum and between the back plate and the flameholder plate. A radiation plate is also connected with respect to the flameholder plate, the radiation plate and flameholder plate forming a combustion chamber with at least one gas flow boundary serving as a heat radiating surface.

26 Claims, 3 Drawing Sheets

INTEGRATED PREMIXED INDIRECT RADIANT BURNER

This application claims the benefit of an earlier filed provisional application having Ser. No. 60/181,480 and a Filing Date of Feb. 10, 2000.

BACKGROUND OF THE INVENTION

1. Field of the Invention

This invention relates to a compact, integrated burner combining the concepts of premixing fuel and oxidant and indirect radiant heating.

2. Description of the Prior Art

Gas-fired infrared, or radiant, burners are of two general types: (1) direct, in which the gas is burnt on a porous solid, a screen, or some other similar device, and the infrared radiation is transmitted by the flame and/or glowing burner, or (2) indirect, in which hot combustion gas is used to heat up a secondary metal surface, which then emits infrared radiation. Generally, indirect burners are also designed such that combustion gas is kept separate from the area to be heated, protecting that area from potential exposure to pollutants and hazardous components in that gas. In cooking and heating applications, both types of burners are used.

Another important classification of burners is based upon the level of mixing of the inlet gases. When the fuel and oxidant are thoroughly mixed prior to introduction to the burner, the flame is known as premixed. Alternatively, when the fuel and oxidant are not thoroughly mixed prior to introduction to the burner, the flame is known as a diffusion flame. Diffusion flames typically have longer and larger flame regions, since the fuel and oxidant only get more intimately comingled, and more capable of igniting, as distance from the inlet increases. Partly for this reason, in diffusion flame applications with indirect radiant heating, the surface being heated is often a tube or plate that is physically separate from the burner assembly and the flame energy is transferred to the radiating surface rather far from the actual burner. On the other hand, in a premixed burner, the entering gas mixture is already capable of igniting completely. Premixed flames tend to burn cleaner and hotter, requiring less of the excess air that dilutes and cools the flame. The radiating surface can be located much closer to the flameholder than a burner using a diffusion flame.

Currently, indirect radiant burners used for space heaters and similar applications are only of the diffusion type, limiting the degree to which those appliances and devices may be made compact and space-saving. Therefore, a need exists to combine the indirect and premixed features of existing burners into a compact, integrated package suitable for space heaters or other applications where a large amount of radiant heat must be released and utilized in a relatively small space.

SUMMARY OF THE INVENTION

It is one object of this invention to provide a burner that combines indirect and premixed features of existing burners into a compact, integrated package suitable for space heaters and other applications where a large amount of radiant heat must be released and utilized in a relatively small space.

It is another object of this invention to provide a burner that heats the radiating surface faster and, if desired, to a higher temperature with less wasted volume for mixing.

It is another object of this invention to provide a burner that is particularly adaptable for removal of additional heat from the combusted gas downstream of the burner assembly.

It is a further object of this invention to provide a burner having a radiation plate formed by the combusted gas plenum, wherein a gas flow boundary also serves as a heat radiating surface.

It is another object of this invention to provide a burner which has great flexibility in the shape and size of the combustion region and the radiant surface.

It is yet another object of this invention to provide a burner which can be operated with the flame propagating either upwards or downwards.

A burner according to one preferred embodiment of this invention comprises a back plate, a flameholder plate and a radiation plate. The back plate preferably accepts at least one inlet for providing fuel and oxidant to a plenum of the burner. The plenum is preferably formed between the back plate and the flameholder plate.

The fuel and oxidant are preferably premixed and either blown or drawn through the flameholder plate. Premixing preferably occurs in the plenum through the action of turbulence, aided by one or more baffles positioned between the flameholder plate and the back plate. The resulting premixture is then fed through the flameholder plate.

Accordingly, the flameholder plate preferably further includes a plurality of ports formed in the flameholder plate downstream of the premixing baffles. The ports permit the premixture to enter a combustion chamber on an opposite side of the flameholder plate as the plenum.

The radiation plate is connected with respect to the flameholder plate and preferably forms a combustion chamber, such as a trough or depression, along which heat transfer to the radiating surface is preferably reasonably uniform. An ignitor preferably ignites the premixture to form a flame that extends from the flameholder plate and into the combustion chamber formed between the radiation plate and a bottom of the flameholder plate. The combustion chamber is preferably formed outwardly with respect to the flameholder plate and in a convex configuration of varying depth.

An outlet is preferably formed in a deep portion of the combustion chamber and is connected to a tube that is connected to a downstream tube or is mateable with a corresponding tube end of a downstream portion, such as a flue vent or a convective heat exchanger, of the device. Air flow can be created through the outlet by either a forced air blower or an induction fan.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

FIGS. 1–5 show burner 10 according to several preferred embodiments of this invention.

Figure 1:
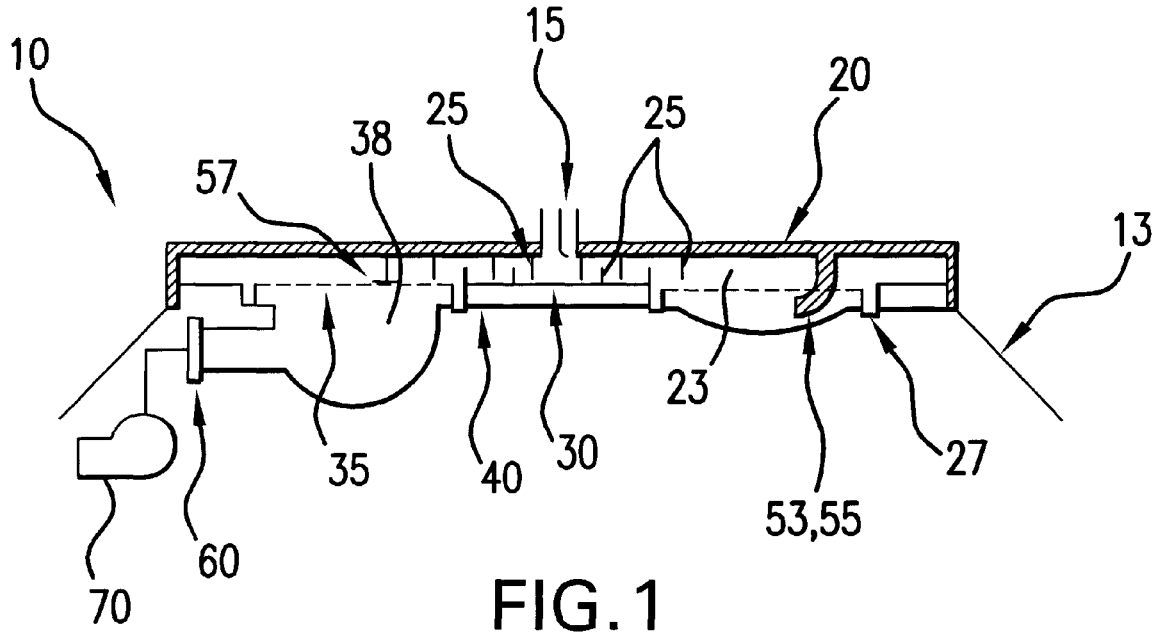
FIG. 1 is a cross-sectional side view of a burner according to one preferred embodiment of this invention.

As shown in FIG. 1, back plate 20 is configured and constructed according to accepted manufacturing procedures and to preferably correspond dimensionally with flameholder plate 30 and radiation plate 40 discussed below. Back plate 20 preferably accepts at least one inlet 15. Inlet 15 preferably comprises a tube or other conduit for providing fuel, such as natural gas, and oxidant, such as air. The fuel and oxidant may be provided through inlet 15 either independently, with a fuel inlet and an oxidant inlet, or jointly, with a premixture inlet.

Figure 2:
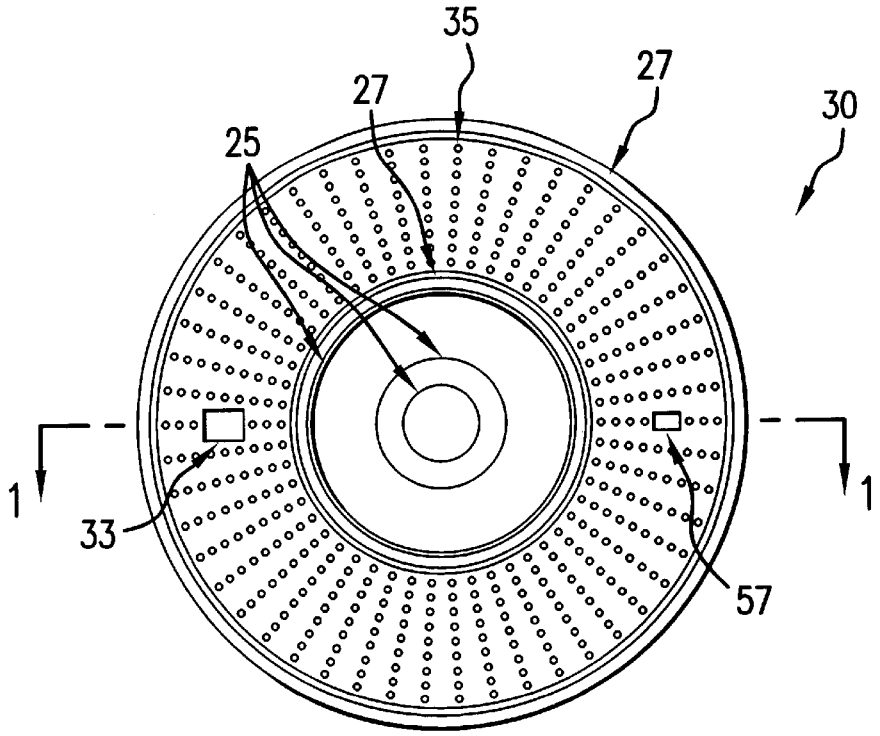
FIG. 2 is a top view of a flameholder plate according to one preferred embodiment of this invention.
Figure 4:
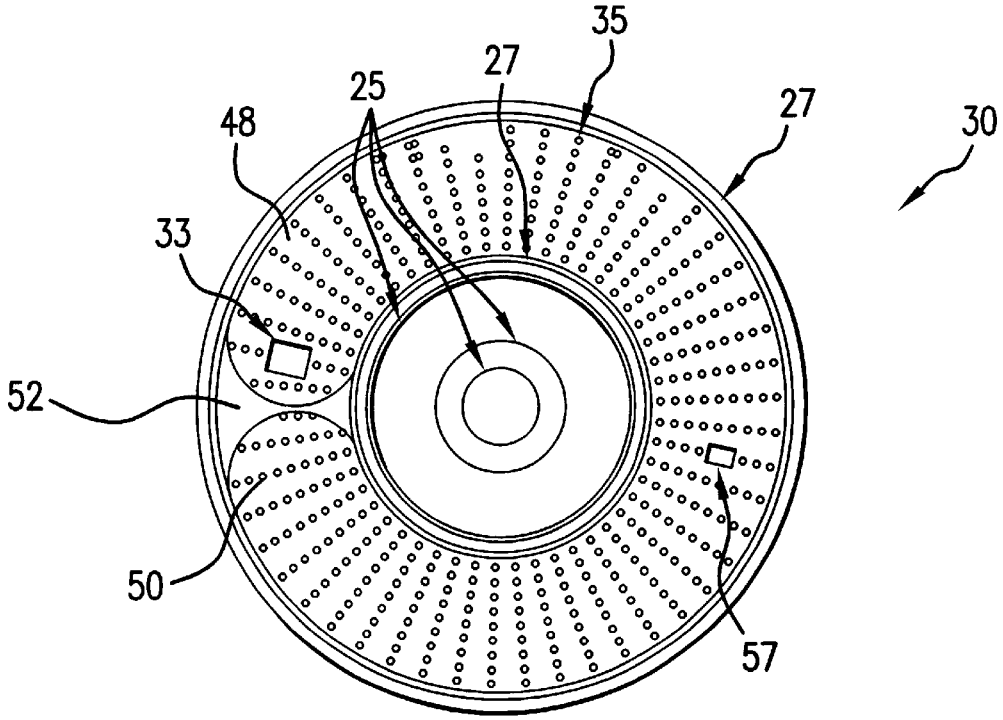
FIG. 4 is a top view of a flameholder plate according to another preferred embodiment of this invention.

According to one preferred embodiment of this invention, back plate 20 provides a mounting surface for flameholder plate 30, shown in FIGS. 2 and 4. Flameholder plate 30 is preferably manufactured from stainless steel or other high-temperature metal with high reflectivity. Plenum 23 is formed between back plate 20 and flameholder plate 30 within which fuel and oxidant are preferably premixed and blown or drawn through flameholder plate 30.

According to one preferred embodiment of this invention, premixing occurs in plenum 23 through the action of one or more baffles 25 positioned or formed between flameholder plate 30 and back plate 20. Baffles 25 may be interwoven, such as in an arrangement of generally concentric rings. As shown in FIGS. 1–5, a plurality of baffles 25 may be formed in concentric rings within plenum 23 and between inlet 15 and the flame ports 35 of the flameholder plate 30. Baffles 25 preferably extend from one or both of back plate 20 and flameholder plate 30, such as baffles 25 shown in FIG. 1.

When plenum 23 is shaped reasonably symmetrically, the centering of baffles 25 allows fuel and oxidant premixing to take place in all directions, radiating from a center of flameholder plate 30 out toward edges of flameholder plate 30. When plenum 23 is not symmetrically shaped, the configuration of baffles 25 and ports 35, discussed below, are preferably designed so that fuel and oxidant distribution still results in a uniform flame downstream of flameholder plate 30. A height of plenum 23 is preferably minimal to keep a volume of fuel and oxidant premixture, referred to as the premixture herein, low, so that any flashback events that may occur would be harmless and cause little or no ignition sound.

Flameholder plate 30 preferably further includes a plurality of ports 35 formed between the premixing baffles 25 and the edge of flameholder plate 30, though not necessarily extending to the edge of flameholder plate 30. Ports 35 are formed and configured to permit the premixture to enter combustion chamber 38 so that heat transfer is reasonably uniform across radiation plate 40, discussed below.

Radiation plate 40 is connected with respect to flameholder plate 30 and preferably forms combustion chamber 45. Radiation plate 40 is preferably keyed 27, crimped, o-ringed, gasketed, double-seamed or otherwise joined with respect to flameholder plate 30 to avoid leakage of flame, fuel, oxidant, combustion gas and/or premixture from outside of burner 10. Back plate 20 is preferably similarly joined with respect to flameholder plate 30 and/or radiation plate 40. Each of back plate 20, flameholder plate 30 and radiation plate 40 are preferably, though not necessarily, formed in a circular shape and regardless of shape are preferably similarly configured to facilitate attachment to each another.

Combustion chamber 38 is formed within trough 45 between radiation plate 40 and a bottom of flameholder plate 30. According to one preferred embodiment, trough 45 is preferably formed outwardly with respect to flameholder plate 30 and in a convex configuration having deep end 50 and shallow end 48. Preferably, though not necessarily, trough 45 is gradually contoured between deep end 50 and shallow end 48.

Figure 3:
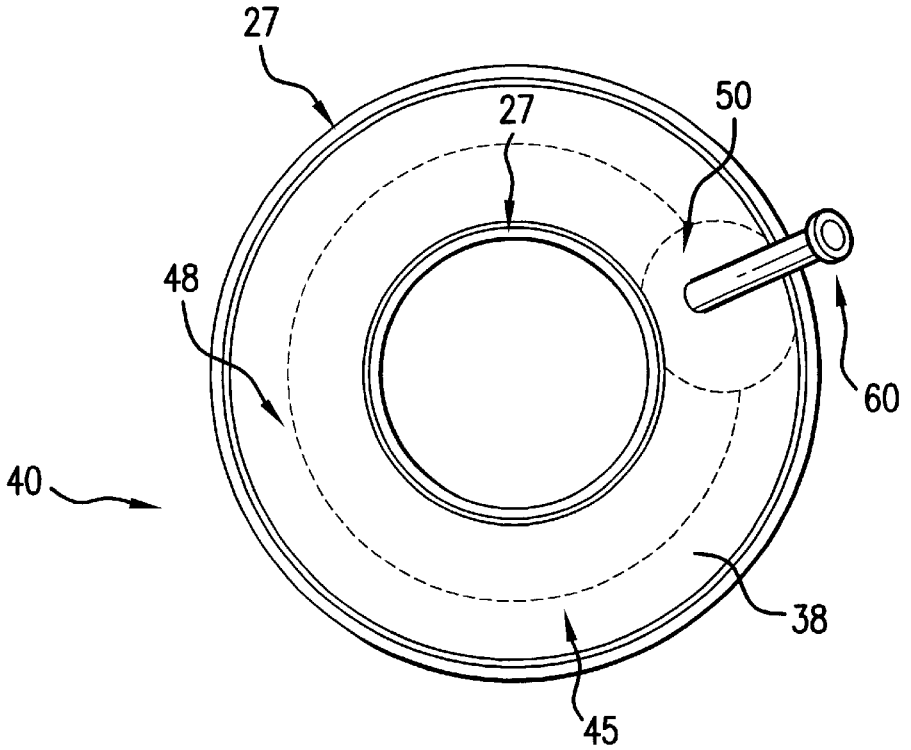
FIG. 3 is a bottom view of a radiation plate according to one preferred embodiment of this invention.

According to one preferred embodiment of this invention shown in FIG. 3, shallow end 48 of trough 45 is formed on an opposite side of radiation plate 40 as deep end 50 of trough 45. According to this embodiment, trough 45 is preferably formed in a toroidal shape wherein a continuous unbroken trough 45 is formed around a perimeter of a center of burner 10.

Figure 5:
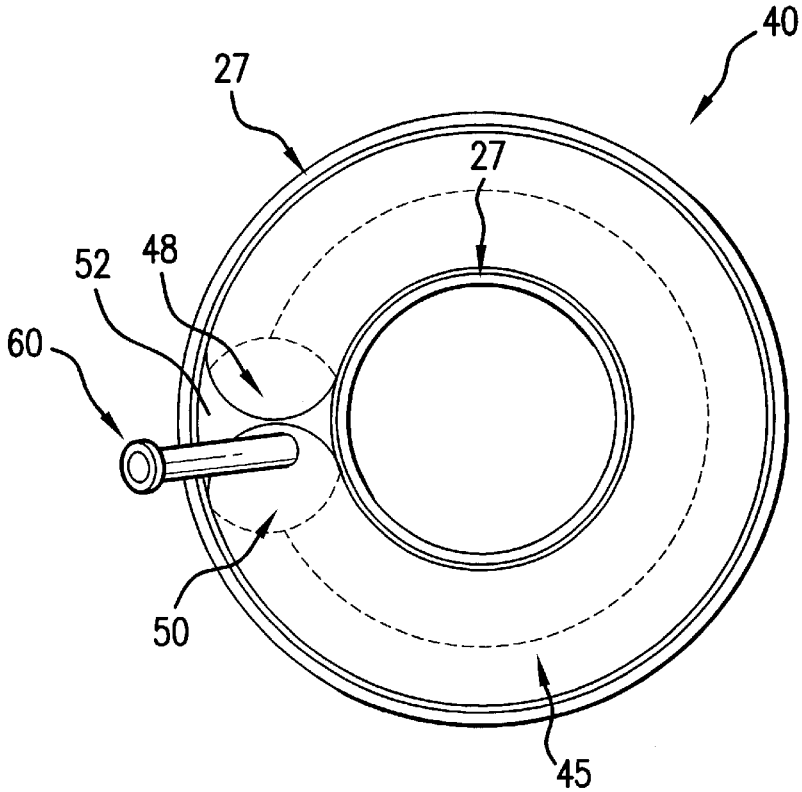
FIG. 5 is a bottom view of a radiation plate according to another preferred embodiment of this invention.

According to one alternate embodiment of this invention shown in FIGS. 4 and 5, combustion chamber 38 and thus trough 45 are formed in a broken toroidal configuration with shallow end 48 at one end of break 52 and deep end 50 at an opposite end of break 52. According to this alternate embodiment, ports 35 in flameholder plate 30 are formed in a toroidal configuration corresponding with the configuration of trough 45.

In addition, ports 35 and/or combustion chamber 38 may be formed in an elliptical, square, rectangular, triangular, star and/or irregularly shaped configuration. Also, ports 35 may be formed in the center area and/or the solid area outside of the described region.

As shown in FIG. 1, burner 10 preferably further comprises ignitor 55 and/or flame sensor 53 connected with respect to back plate 20. Ignitor 55 and/or flame sensor 53 preferably extends through opening 33 in flameholder plate 30 and into trough 45. Alternatively, ignitor 55, or similar ignition mechanism, may be positioned with respect to burner 10 in any manner that effectively ignites the gas in combustion chamber 38.

Since a flame front, also called a blue zone, ends close to the bottom surface of flameholder plate 30 instead of passing down combustion chamber 38 in the downstream direction, the depth of combustion chamber 38 may be varied so as to accommodate increasing gas flow as outlet 60 is approached, without risk of quenching the flame. This assists in causing heat transfer to the radiation plate 40 to be uniform throughout combustion chamber 38. Because of the increasing gas flow in the combustion chamber 38 as outlet 60 is approached, outlet 60 is preferably formed in deep end 50 of combustion chamber 38. Since the premixture creates a short flame, the flame front does not impinge on the surface of trough 45 directly, avoiding excessive and damaging metal temperatures that would exist in such a high-curvature zone if the burner were of the diffusion type.

The shape, diameter, and depth variations of combustion chamber 38 can be modified to cause more or less radiant heat release as desired. Reduced radiant heat output is particularly appropriate for systems requiring further heat extraction downstream of the burner. The integral nature of burner 10 according to this invention allows very high curvature of combustion chamber 38, unlike typical combustion assemblies involving metal tubing, which cannot be bent so tightly. The hole pattern of ports 35 in flameholder plate 30 can also be varied to ensure balanced and optimum operation. The above-described parameters also interact with the radiation reflector 13 and view factors for radiative heat transfer to result in the desired heating pattern and radiative energy density. In typical space heaters, radiative heat transfer is strongly dependent upon the heater-to-floor specular view factor. Burner 10 has a high value of that view factor, allowing efficient radiative output from the heater.

Figure 1A:
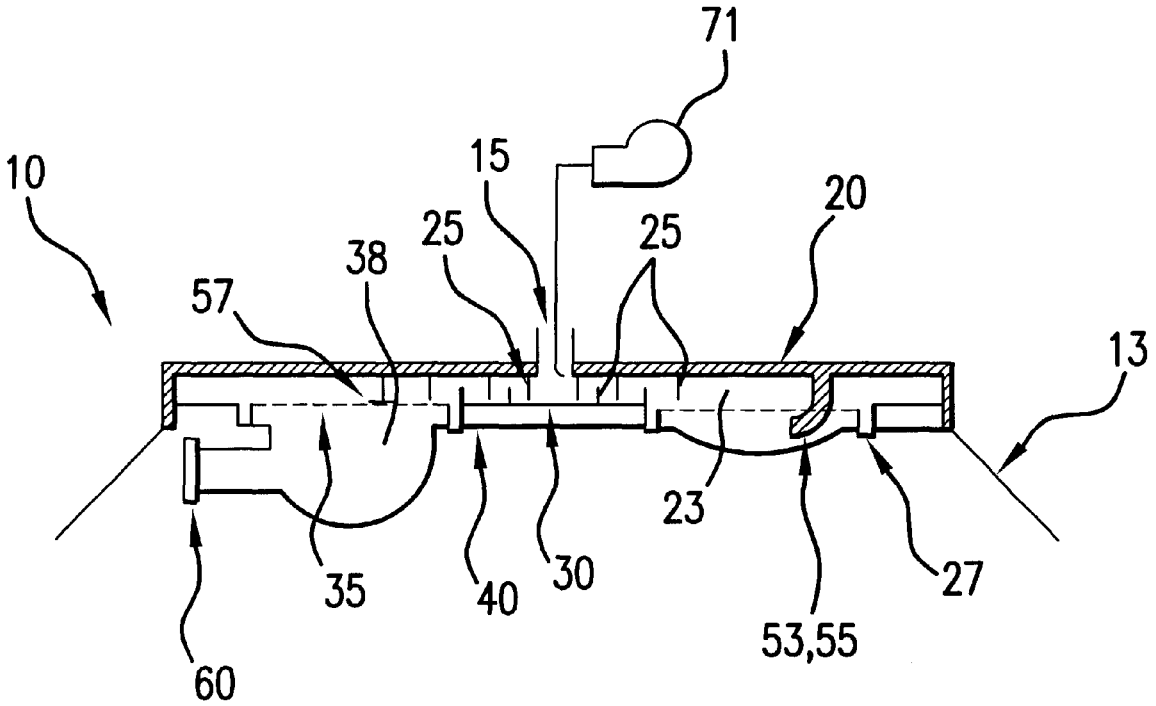
FIG. 1A is a cross-sectional side view of a burner according to one preferred embodiment of this invention.

In one preferred embodiment of this invention, outlet 60 is welded or otherwise connected to a tube that is mateable with a corresponding tube end of a downstream portion of the appliance or device. Air flow can be created through outlet 60 by either a forced air blower, also called a power burner, or an induction fan. An induction fan 70 is preferably positioned downstream of outlet 60 as shown in FIG. 1. A blower 71 is preferably positioned upstream of outlet 60 and preferably upstream of inlet 15 as shown in FIG. 1A.

According to one preferred embodiment of this invention, a center of radiation plate 40 is not heated as much as trough 45 within combustion chamber 38. The material used and thickness of radiation plate 40 will determine how hot that area will get and therefore whether that area itself radiates significant amounts of heat. Depending on that factor and the specific application, reflective center (not shown), such as a small, cylindrical or conic section shaped reflector, may be positioned or formed in the center portion of the bottom of radiation plate 40 to optimize heat transfer from combustion chamber 38. In addition, as described above, flameholder plate 30 preferably comprises a high-temperature, high reflectivity metal that improves reflection back to radiation plate 40 and, together with convective cooling from the air flow through burner 10, keeps flameholder plate 30 sufficiently cool to avoid igniting the premixture in plenum 23 and prior to injection into combustion chamber 38. Finally, radiation reflector 13, shown in FIG. 1, may be positioned around a perimeter of burner 10 to assist in radiative heating within burner 10.

In a method for heating according to one preferred embodiment of this invention and resulting from the use of burner 10 according to one preferred embodiment of this invention, fuel and oxidant are introduced into inlet 15. The fuel and oxidant are preferably directed through a plurality of baffles 25 to form a premixture. The premixture is next preferably directed through the plurality of ports 35. Ignitor 55 ignites the premixture in combustion chamber 38 to form a flame. The configuration of burner 10 then directs hot combustion gases generated by the flame against radiation plate 40 and across combustion chamber 38 having deep end 50 and shallow end 48 formed within flameholder plate 30 and radiation plate 40. Finally, the hot combustion gases are conveyed into outlet 60 formed in deep end 50 of combustion chamber 38.

According to one preferred embodiment of this invention, a temperature limit of the flameholder plate 30 is sensed by limit switch 57, or similar device and a flow of the fuel and oxidant is correspondingly adjusted or disrupted. This operation reduces the risk of overheating for burner 10 or any associated device.

While in the foregoing specification this invention has been described in relation to certain preferred embodiments thereof, and many details have been set forth for purpose of illustration, it is to be understood, as aforementioned, that this invention is susceptible to additional embodiments and that certain of the details described herein can be varied considerably without departing from the basic principles of the invention expressed herein.

We claim:

1. A gas-fired burner comprising:

a back plate, the back plate having at least one inlet tube;

a flameholder plate having a gas impervious region and forming a plurality of ports peripherally disposed around at least a portion of said gas impervious region, the flameholder plate positioned on the back plate and forming a plenum between the back plate and the flameholder plate;

a radiation plate connected with respect to the flameholder plate, the radiation plate and the flameholder plate forming a combustion chamber there between configured substantially coincident with said plurality of ports wherein at least one gas flow boundary also serves as a heat radiating surface; and an outlet formed in the combustion chamber.

2. The gas-fired burner of claim 1 wherein the at least one inlet tube comprises a fuel inlet and an oxidant inlet.

3. The gas-fired burner of claim 1 wherein a plurality of mixing baffles arc formed between the back plate and the flameholder plate.

4. The gas-fired burner of claim 3 wherein at least one baffle is formed in a ring extending outwardly from at least one of the back plate and the flameholder plate.

5. The gas-fired burner of claim 1 wherein the combustion chamber forms a trough or depression.

6. The gas-fired burner of claim 5 wherein the trough or depression has a deep region and a shallow region.

7. The gas-fired burner of claim 6 wherein the shallow region of the combustion chamber is formed on an opposite side of the radiation plate as the deep region of the combustion chamber.

8. The gas-fired burner of claim 1 further comprising an ignitor connected with respect to the back plate.

9. The gas-fired burner of claim 8 wherein the ignitor extends through the flameholder plate and into the combustion chamber.

10. The gas-fired burner of claim 6 wherein the combustion chamber is gradually contoured between the deep region and the shallow region.

11. The gas-fired burner of claim 6 wherein the combustion chamber is formed in a broken toroidal configuration having a break with the shallow region at one end of the break and the deep region at an opposite end of the break.

12. The gas-fired burner of claim 1 wherein the ports in the flameholder plate are formed in a toroidal configuration.

13. A radiant burner comprising:

an inlet;

a flameholder plate having a gas impervious center region and forming a plurality of flame ports around at least a portion of the gas impervious center region, forming a plenum with the inlet;

a radiation plate connected with respect to the flameholder plate, the radiation plate and the flameholder plate forming a combustion chamber having a configuration corresponding to a flame port configuration of said plurality of flame ports, wherein at least one gas flow boundary also serves as a heat radiating surface; and an outlet formed in the combustion chamber.

14. The radiant burner of claim 13 further comprising an induction fan positioned downstream of the outlet.

15. The radiant burner of claim 13 further comprising a blower positioned upstream of the inlet.

16. The radiant burner of claim 13 further comprising a plurality of baffles formed within the plenum between the inlet and the flame ports of the flameholder plate.

17. The radiant burner of claim 16 wherein the baffles are formed in generally concentric rings within the plenum between the inlet and the flame ports of the flameholder plate.

18. The radiant burner of claim 13 wherein the combustion chamber forms a trough or depression.

19. The radiant burner of claim 18 wherein the trough contains a shallow region and a deep region.

20. The radiant burner of claim 19 wherein the trough extends away from the flameholder plate in a configuration that transitions from the shallow region to the deep region.

21. A method for heating comprising the steps of:

introducing fuel and oxidant into an inlet;

directing the fuel and oxidant through a plurality of baffles to form a premixture;

directing the premixture through a plurality of ports disposed between said plurality of baffles and a periphery of a flameholder plate;

igniting the premixture to form a flame;

directing hot combustion gases generated by the flame against a radiation plate and across a combustion chamber formed between the radiation plate and the flameholder plate and configured to correspond to said disposition of said plurality of ports; and conveying the hot combustion gases into an outlet formed in the combustion chamber.

22. The method of claim 21 wherein the premixture is drawn through the plurality of ports.

23. The method of claim 21 wherein the premixture is blown through the plurality of ports.

24. The method of claim 21 wherein the combustion chamber forms one of a trough and a depression.

25. The method of claim 24 wherein the one of the trough and the depression has a deep region and a shallow region.

26. The method of claim 21 further comprising the steps of:

sensing a temperature limit of the flameholder plate; and adjusting or disrupting a flow of at least one of the fuel and oxidant when the temperature limit is reached.

* * * * *